US005526534A

United States Patent [19]

Lazar

[11] Patent Number: 5,526,534

[45] Date of Patent: Jun. 18, 1996

[54] WASHABLE BLAZER AND METHOD OF CONSTRUCTION THEREOF

[75] Inventor: Robert P. Lazar, Pittsburgh, Pa.

[73] Assignee: Artcraft Uniform Company, Pittsburgh, Pa.

[21] Appl. No.: 218,162

[22] Filed: Mar. 25, 1994

[51] Int. Cl.[6] ..... A41D 1/02; A41D 27/02

[52] U.S. Cl. ..... 2/97; 2/272; 2/243.1; 112/424

[58] Field of Search ..... 2/97, 272, 243.1, 2/274, 275, 85, 93; 112/440, 424; 156/93, 90, 91, 85

[56] References Cited

U.S. PATENT DOCUMENTS

| | | | |
|---|---|---|---|
| 2,744,844 | 5/1956 | Wood, Jr. et al. | 2/274 |
| 3,478,366 | 11/1969 | Kaufman | 2/274 |
| 3,766,566 | 10/1973 | Tadokoro | 2/275 |
| 4,561,128 | 12/1985 | Zimmerman | 2/275 |
| 4,604,152 | 8/1986 | Liukko | 2/275 |

*Primary Examiner*—C. D. Crowder
*Assistant Examiner*—Gloria Hale
*Attorney, Agent, or Firm*—Eckert Seamans Cherin & Mellott; Arnold B. Silverman; Suzanne Kikel

[57] ABSTRACT

A durable, attractive, lined garment, such as a blazer, that can be repeatedly washed in an aqueous solution containing laundering agents is constructed of a washable outer fabric, such as polyester, a polyester/natural fiber blend or corduroy, and a synthetic liner, such as polyester. A seam between the washable fabric and liner fabric is constructed by first sandwiching the washable fabric between the liner and a flexible tape made from a non-woven fabric having an adhesive on each side. The three materials are joined along a common edge with an overlock stitch, and also joined with a tacking stitch spaced a short distance apart from the overlock stitch. The adhesive is then employed to further join the washable fabric to the tape. Another type of seam additionally includes a wiggin between the tape and the washable fabric, wherein the adhesive adheres the tape to the wiggin.

29 Claims, 2 Drawing Sheets

WASHABLE BLAZER AND METHOD OF CONSTRUCTION THEREOF

BACKGROUND OF THE INVENTION

1. Field of the Invention

This invention relates to the construction of lined, wash-and-wear garments made in significant part from washable fabrics, and, more particularly, to the construction of attractive, durable, wash-and-wear blazers.

2. Description of the Prior Art

Wash-and-wear fabrics made from synthetics, such as polyester and synthetic-natural fiber blends, have been in use for decades for simple garments such as shirts. However, it has been more difficult to construct wash-and-wear lined garments such as blazers. The lining and outer garment fabric of blazers are typically made from different fabrics having different washability and shrinkage characteristics. Seams can be bulky, often requiring reinforcing interliners, such as tapes. After being washed in a water-based cleaning solution, such garments generally need pressing. In addition, these garments typically do not stand up well to repeated machine washing. The edges of the different materials tend to fray at their joining seams after one or more washings. Therefore, most users resort to relatively expensive and time-consuming dry-cleaning to keep their blazers presentable.

This is not a serious problem for a user who only occasionally wears a blazer. However, there are those who must wear the same garment almost every day in their profession, such as uniformed security guards and other uniformed service personnel, to whom dry-cleaning is an expensive inconvenience.

Therefore, there is a need for a construction for a durable, attractive, lined garment that can be washed repeatedly in an aqueous laundering solution without serious deleterious effect.

SUMMARY OF THE INVENTION

This need and others are satisfied with the present invention for the construction of a lined garment. As used herein, the term "lined garment" shall refer to the broad class of garments that include an inner lining joined to an outer material (or shell), and shall expressly include but not be limited to suit coats, jackets, raincoats, blazers and other lined garments made in significant part from washable fabrics.

According to the invention, the garment includes an outer fabric that is preferably a polyester, a synthetic-natural fiber blend or a corduroy fabric, and that is washable in an aqueous solution containing cleaning agents without serious deleterious effects. The lining for the garment is preferably made of a washable synthetic fabric, such as polyester. The outer fabric is generally used for an outer shell of the garment and also for a front facing, each of which can be joined to the lining. The shell and the lining are typically assembled separately and then joined during final assembly of the garment.

According to one aspect of the invention, at least one seam between the lining and the outer fabric of a washable lined garment, such as that joining the front facing and the lining on a blazer, is constructed with a flexible tape, preferably made from a non-woven fabric, that has adhesive on each side. The tape, the outer fabric and the lining are sandwiched together in that order. The three fabrics are joined along a common edge with an overlock stitch to resist fraying and can be further joined by a straight tacking stitch spaced a short distance from the overlock stitch distal from the common edge to reinforce the overlock stitch. Methods well known in the garment industry, such as pressing or pressing in combination with moist heat, can be used to activate the tape adhesive after another layer of outer garment material is overlaid on top of the exposed side of the tape during final assembly of the garment.

Another type of seam for a washable, lined garment, used, for example, at a bottom hem of a lined blazer, is constructed, according to another aspect of the invention, by sandwiching together a washable, synthetic liner fabric, a washable outer fabric, a wiggin (for added body) and a flexible fabric tape having an adhesive on each side. Then the sandwiched structure is sewn together along a common edge with an overlock stitch to resist fraying. A straight, or tacking, stitch spaced a short distance apart from the lockstitch remote from the common edge can preferably be used for reinforcement. The adhesive facing the wiggin is activated by well known methods at a later time to further join the wiggin and tape.

A patch pocket for a washable, lined garment, such as a blazer, can be constructed from a washable outer fabric, or shell, as described above. A piece of the shell is first layered with and fused to a piece of fusible fabric, such as a hardite finish fabric, having a heat activated adhesive on the side facing the shell. The fused material is then cut to a desired size and shape. A fusible tape is sewn across the top edge of the fused material, using an overlock stich along a common edge to resist fraying and a straight stitch spaced a short distance from the overlock stitch and remote from the common edge for reinforcement. A top hem of the pocket is formed by folding the top edge, including the exposed side of the tape, over onto the fusible fabric and then employing the adhesive. The other edges of the pocket are folded and creased such that only a smooth edge is visible from the an exposed side of the pocket after attachement to the blazer shell. The pocket can then be sewn along its sides and bottom edges onto the front of the blazer with a straight stitch, such as, for example, a lockstitch.

According to another aspect of the invention, a method for laundering a garment, such as that described above, without serious deleterious effects includes the steps of providing such a garment and then washing it in a washing machine with a water-based solution containing cleaning agents, such as detergents. The method can include the further step of drying the garment in an automatic dryer.

According to yet another aspect of the invention, a method for constructing a lined garment includes the steps of providing an outer fabric, such as used for the facing or shell of a blazer, that is washable without serious deleterious effects, a washable, synthetic liner fabric and a flexible tape having an adhesive on each side, sandwiching the outer fabric between the adhesive tape and the liner fabric such that each has an edge commonly aligned with the others, joining the three materials together along the common edge with an overlock stitch, further joining the three materials together with a tacking stitch aligned parallel to and spaced a short distance apart from the overlock stitch, and further joining the materials by employing the adhesive.

According to yet another aspect of the invention, a method for constructing a lined garment includes the steps of providing an outer fabric, or shell, that is washable without serious deleterious effects, a washable, synthetic liner fabric, a wiggin and a flexible tape having an adhesive on at least one side, then sandwiching together, in order of placement in a layered structure having a common edge, the lining fabric, the shell fabric, the wiggin, and the adhesive tape. The layered structure is sewn together at a common edge with an overlock stitch to resist fraying and a straight stitch spaced a short distance from the overlock stitch and remote from the common edge for added reinforcement. The layered structure is then further adhered together by employing the adhesive on the tape by well known methods.

It is an object of this invention to provide a construction for attractive, durable lined garments that can be repeatedly washed in a water-based laundering solution without serious deleterious effects to the garment.

It is another object of this invention to provide a construction for an attractive lined garment that will be presentable with no ironing or only touch-up ironing after laundering in an aqueous cleaning solution.

It is another object of this invention to provide a method for construction of a lined garment than can be washed repeatedly in an aqueous solution.

It is another object of this invention to accomplish the foregoing objects in an economical manner consistent with existing garment manufacturing technology.

These and other objects of the present invention will be more fully understood from the following description of the invention with reference to the illustrations appended hereto.

DESCRIPTION OF THE PREFERRED EMBODIMENTS

Figure 1:
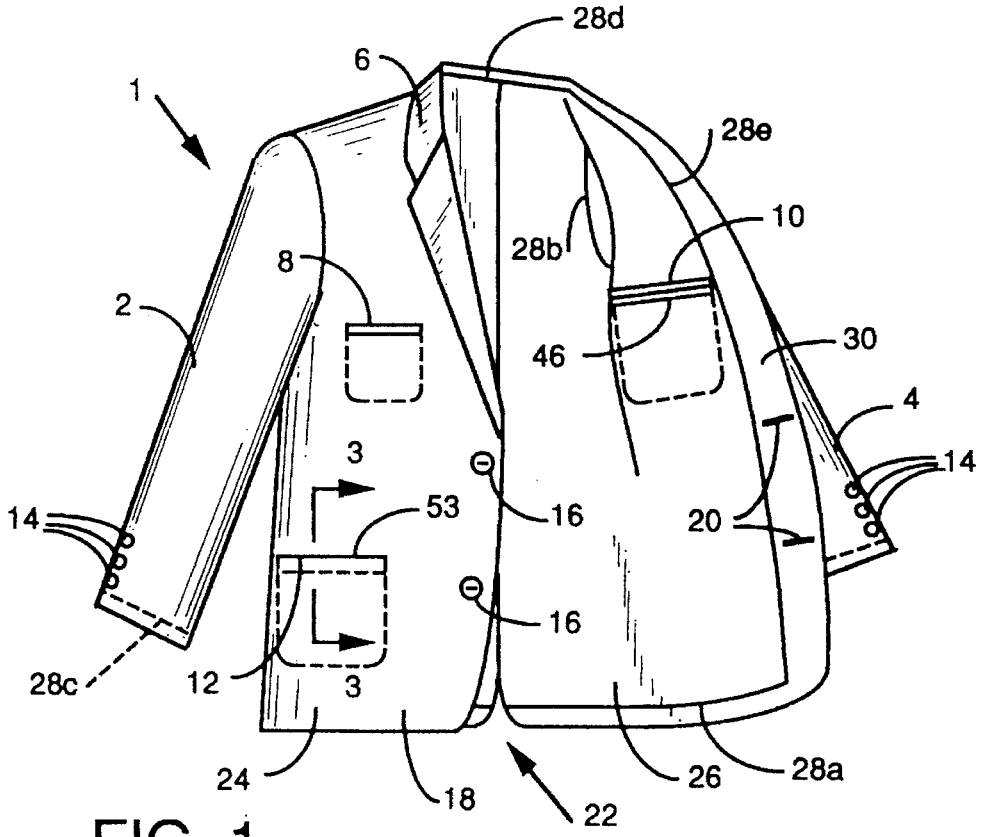
FIG. 1 is a front elevation view of the front of a blazer constructed according to the present invention, with one side opened to reveal the lining and facing.

Referring now to the drawings, and in particular to FIG. 1, a lined blazer 1 constructed according to the present invention is shown in front elevational view such that one side is opened. The blazer is of a common style, with sleeves 2, 4, notch collar 6, inside and outside breast pockets 8, 10, bottom patch pockets 12, brass buttons 14 on the sleeves 2, 4, brass buttons 16 at the front 18, buttonholes 20 and a rear vent 22.

The shell fabric 24 used to form the shell, or outer portion of the garment, is made of a material that is washable in an aqueous laundering solution without serious deleterious effects. The laundering solution may contain standard cleaning agents known in the art, such as detergents, softeners, whiteners, enzymes and the like. Three such fabrics that can be used for the outer fabric are polyester, wash-and-wear synthetic-natural fiber blends and corduroy, however other fabrics that are now known or that may be developed in the future having substantially similar washability characteristics would also be appropriate.

The liner fabric 26 is also washable, and is preferably made from a washable, synthetic material such as polyester. As with the shell fabric 24, it is understood that the liner fabric 26 can be fabricated from other fabrics that are now known or that may be developed in the future having substantially similar washability characteristics. The liner fabric 26 is joined to the shell fabric 24 at seams located, for example, running alongside the bottom hem of the blazer 28*a*, at armholes 28*b*, the ends of sleeves 28*c*, and collar 28*d*. The liner material 26 is also joined to a facing fabric 30, generally made of the same fabric as the shell fabric 24, at seams 28*e* at the interior sides of the blazer.

Figure 2:
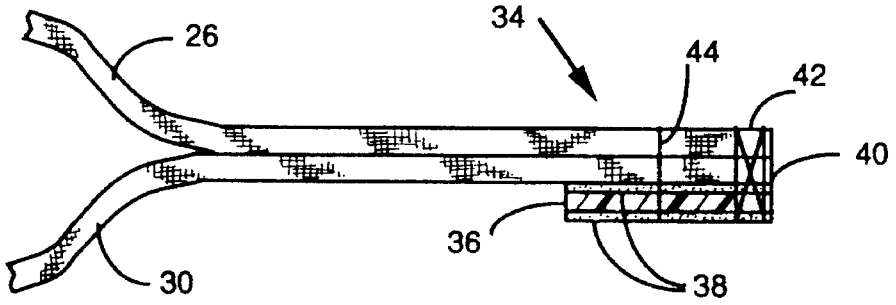
FIG. 2 is a partial cross-sectional view of a first type of seam joining a liner fabric to a facing fabric in a partially completed stage of construction.

The inside portion of the blazer, including the liner and the facing, is first formed from several pieces, including liner fabric 26, before joining to the outer portion, or shell. Referring now to FIG. 2, a seam 34 joining the liner fabric 26 to the facing fabric 30 according to the present invention is constructed by sandwiching the facing fabric 30 between the liner fabric 26 and a length of flexible fabric tape 36 about 0.375 inch to about 0.5 inch wide that is preferably made from a non-woven material. The tape 36 preferably has an adhesive 38 on each side that may be pressure sensitive or thermally activated preferably by moist heat, such as steam, however, the adhesive is not employed at this stage of construction. The three materials sandwiched together form a three-tiered layered structure having a common edge 40. The layered structure is joined by an overlock stitch 42 along the common edge 40 and by a straight, or tacking, stitch 44 parallel to and spaced apart from the overlock stitch 42, remote from the common edge 40. Both stitches can be made simultaneously by a serging machine.

The lining is generally assembled by joining pieces of the lining fabric 26 at seams without the use of the flexible fabric tape 36. However, in order to resist fraying during repeated laundering, an overlock stitch is preferably used for such seams. The liner backseam, the liner sleeves and cuffs, and the liner shoulder are all joined with an overlock stitch that can be made together with a straight, or tacking, stitch with a serging machine. An automatic pocket machine, well known in the art, makes double besom pockets 46 with material that includes the previously described liner fabric 26 joined to facing fabric 30. The pockets 46 are turned and a lining bag (not shown) sewn on to make a finished pocket. After the lining sleeves are set, the lining is complete.

The shell of the washable blazer, which can include, for example, patch pockets 12 and welt pockets 8, is assembled separately from the interior lining. All shell seams joining pieces of shell fabric 24 to shell fabric 24 are joined by a single needle straight stitch, such as a lockstitch. The collar 6 is sandwiched together, turned and pressed. The outseam and inseam of the sleeves are sewn and pressed. The back, generally made of two pieces, is joined and pressed. The front of the shell is assembled and pressed. The bottom patch pockets 12 are marked and sewn on.

Figure 3:
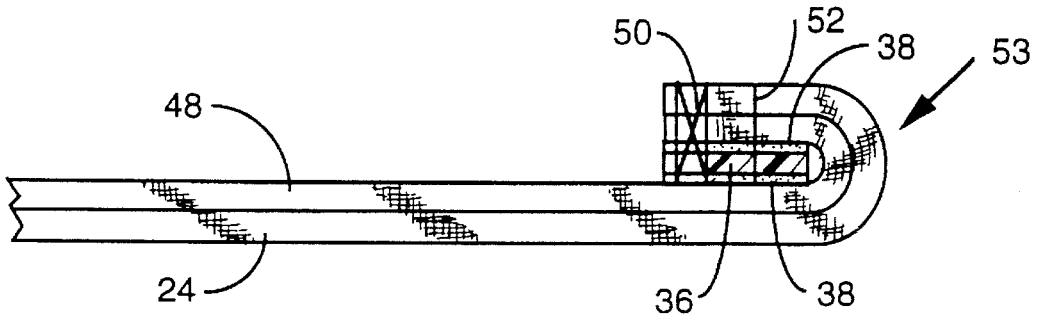
FIG. 3 is a cross-sectional view through line 3—3 of FIG. 1 illustrating the construction of a bottom patch pocket.

Referring now to FIG. 3, a bottom patch pocket 12 is constructed by first joining a sheet of fusible fabric 48, such as a finish fabric having a thermally activated form of adhesive on one side, to a piece of shell fabric 24 as described hereinbefore, by, for example, pressing them together in a pressing machine at about 280°–300° F. according to industry standard methods. After the fused together material is cut to a predetermined size and shape (a step typically performed by machine that die cuts the material), a strip of flexible fabric tape 36, as described hereinbefore and preferably having an adhesive on each side, is placed along the top edge on the finish fabric side. The tape 36 is joined to the fused-together shell fabric 24 and finish fabric 48 using an overlock stitch 50 along a common edge of the three materials and a straight, or tacking, stitch 52 spaced a short distance from the overlock stitch 50 remote from the common edge. Again, a serging machine can be used to make both stitches together. A top hem 53 of the pocket is formed by folding the top edge, including the tape 36, over onto the fusible fabric 48 and then employing the adhesive 38 on the tape 36. The other edges of the pocket are folded over about 0.375 inch to 0.5 inch and creased, typically by machine, such that only a smooth edge shell fabric 24 is visible. The pocket 12 can then be sewn along its sides and bottom edges onto the front of the blazer shell with a lockstitch. Preferably, fusible fabric 48 is a type of fabric well known to those in the art and which is especially associated with the Harodite mill located in Massachusetts.

Final assembly of the blazer includes the steps of sewing, preferably with a lockstitch, the shell fronts to the back at the shoulders and side seams, setting the sleeves and the shoulder pads, and sewing a wiggin 54 to the bottom hem **28*a* of the shell. The wiggin 54 may be a strip of heavy, gauze-like fabric cut on a bias, preferably about 1.0 to 1.5 inches wide. It provides added body to the bottom hem 28*a*** so that the jacket drapes properly. The collar is set to the shell. Then the complete lining is set to the shell fronts and across the neckline.

In joining the shell fronts to the part of the assembled interior of the blazer that includes the facing fabric 30, the front shell fabric 24 is placed on the exposed side of the tape 36 of the layered structure described hereinbefore and illustrated in FIG. 2. The tape 36 is then joined to the facing fabric 30 and to the shell fabric 24 by employing the adhesive 38. If the latter type of adhesive described hereinbefore is used, a utility press provides top and bottom steam to adhere the tape 36 and then a vacuum is used for drying. The shell fabric 24 and facing fabric 30 are further joined at a common edge by a single needle stitch, such as a lockstitch.

Figure 4:
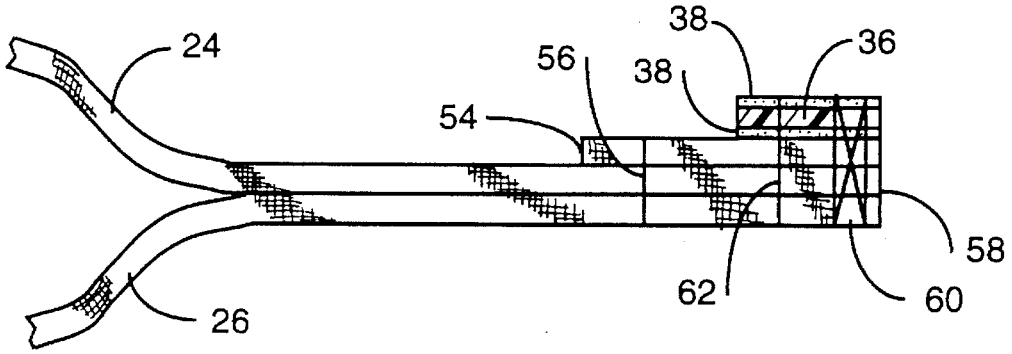
FIG. 4 is a cross-sectional view of a second seam joining liner fabric to shell fabric at the bottom hem of a blazer in a partially completed stage of construction.

The bottom hem **28*a* and vent 22 of the assembled shell is joined to the assembled liner as a final step before turning the blazer. This process is illustrated in a partial stage of construction in cross section in FIG. 4. As described above, the bottom hem 28*a* (see, also, FIG. 1 ) of the shell fabric is first joined to the wiggin 54 with a single needle stitch 56, such as a lockstitch. The liner fabric 26 is layerered on top of the shell fabric 24, and the fabric tape 36 having adhesive 38 on both sides is layered on top of the wiggin 54 to form a four-tiered structure. The four-tiered structure is then sewn together along a common edge 58 with an overlock stitch 60 and a straight, or tacking stitch 62 spaced a short distance from the overlock stitch 60 and remote from the common edge 58. Again, this can be done most efficiently with a serging machine. The shell fabric 24 is then folded back over the exposed face of the tape 36. The tape 36 can thereafter be employed to adhere to the shell fabric 24 and to the wiggin 54 by well known methods such as those described hereinabove. The joining of the liner fabric 26 to the bottom hem 28*a*** is usually the last step before turning the garment, topstitching, and final pressing.

Lined garments constructed according to the methods described above will be capable of withstanding repeated washings in either home or commercial washing machines without exhibiting the undesirable effects that prior art constructions often suffer. Experimental tests have shown that the liner and outer fabric materials generally will not show fraying at their common edges at the seams, even after twenty washings. The lined garment of this invention can be tumble dried or drip-dried after washing. If desired, only touch-up ironing may be done to the garment after washing and drying, as is the case with most wash-and-wear garments.

While for convenience and simplicity of disclosure herein reference has been made to a tape having adhesive on both sides, it will be appreciated that the invention is not so limited, and that the fabrics to which the tape is adhered to may have adhesive secured thereto in lieu of presecurement of adhesive to the tape. Also, in the alternative, adhesive may be introduced between the layers to be joined during fabrication.

Whereas particular embodiments of the present invention have been described above for purposes of illustration, it will be appreciated by those skilled in the art that numerous variations of the details may be made without departing from the invention as described in the appended claims.

I claim:

1. A durable, lined garment capable of being repeatedly washed in an aqueous laundering solution without serious deleterious effects on the garment, comprising a flexible fabric tape, an outer fabric made from washable material, and a liner fabric made from a washable synthetic material, wherein said liner fabric is joined to the outer fabric at a seam, the seam characterized in that the outer fabric is sandwiched between the tape and the liner fabric to form a layered structure joined by an overlock stitch at or adjacent to a common edge of each of the outer fabric, the liner fabric and the tape and further joined by a straight stitch spaced apart from and generally parallel to the overlock stitch, and further characterized in that the tape is further joined to the outer fabric by adhesive means.

2. The lined garment of claim 1, characterized in that the tape comprises a non-woven fabric.

3. The lined garment of claim 2, characterized in that the adhesive means comprises a pressure sensitive adhesive.

4. The lined garment of claim 2, characterized in that the adhesive means comprises a thermally activated adhesive.

5. The lined garment of claim 1, characterized in that the outer fabric includes at least one material selected from the group consisting of polyester, wash-and-wear polyester blends, and corduroy.

6. The lined garment of claim 1, characterized in that the liner fabric includes polyester.

7. The lined garment of claim 6, characterized in that the outer fabric is selected from the group of materials consisting of polyester, a polyester/natural fiber blend and corduroy.

8. The lined garment of claim 1, characterized in that the lined garment is selected from the group of garments consisting of blazers, raincoats, suit coats, and jackets.

9. A durable, lined garment capable of being repeatedly washed in an aqueous laundering solution without serious deleterious effects on the garment, comprising a flexible fabric tape, a wiggin, an outer fabric made from washable materials, and a liner fabric made from a washable synthetic material wherein said liner fabric is joined to the outer fabric at a seam, the seam characterized by a four-tier structure having a common edge comprising, in order of arrangement, the liner fabric, the outer fabric, the wiggin and the tape, the four-tier structure joined by an overlock stitch at or adjacent to the common edge and further joined by a straight stitch spaced apart from and generally parallel to the overlock stitch, and further characterized in that the tape is further joined to the wiggin by adhesive means.

10. A durable, lined blazer capable of being repeatedly washed in an aqueous laundering solution without serious deleterious effects on the blazer, comprising seam joint means, a flexible, non-woven fabric tape having adhesive means on each side for activation by at least one of heat and pressure, an outer fabric made from washable materials, a liner fabric made from a washable synthetic material, said seam joint means including a first seam joining and a second seam joining, said first seam joining, in order of arrangement, the tape, the outer fabric, and the liner fabric, the seam characterized by an overlock stitch at or adjacent to a common edge of each of the tape, the outer fabric and the liner fabric, and by a straight stitch spaced apart from and generally parallel to the overlock stitch, wherein the outer fabric is further joined to the tape by the adhesive means; and said second seam joining, in order of arrangement, the tape, the wiggin, the outer fabric, and the liner fabric, the seam characterized by an overlock stitch at or adjacent to a common edge of each of the tape, the wiggin, the outer fabric and the liner fabric, and by a straight stitch spaced apart from and generally parallel to the overlock stitch, wherein the wiggin is further joined to the tape by the adhesive means.

11. The lined garment of claim 10, characterized in that the outer fabric is selected from the group of materials consisting of polyester, wash-and-wear polyester blends, and corduroy.

12. The lined garment of claim 10, characterized in that the liner fabric is polyester.

13. The lined garment of claim 12, characterized in that the outer fabric is selected from the group of materials consisting of polyester, a polyester/natural fiber blend and corduroy.

14. A method of constructing seam joint means for a durable, lined garment that is capable of being repeatedly washed in a water-based solution containing laundering agents without suffering serious deleterious effects to the garment, comprising the steps of:

providing an outer fabric that is made from a washable material, a liner fabric made from a washable synthetic material and a flexible fabric tape;

sandwiching the outer fabric between the tape and the liner fabric to form a layered structure;

joining the layered structure with an overlock stitch at or adjacent to a common edge of the tape, the outer fabric and the liner fabric;

joining the layered structure with a tacking stitch spaced apart from and parallel to the overlock stitch; and employing adhesive means to further join the outer fabric to the tape.

15. The method of claim 14, wherein the tape comprises a non-woven fabric having an adhesive material on one side selected from the group consisting of pressure sensitive adhesives and thermally activated adhesives.

16. The method of claim 15, wherein the sandwiching step is characterized by the step of placing the tape in surface-to-surface contact with the outer fabric and by the step of placing the outer fabric in surface-to-surface contact with the liner fabric.

17. The method of claim 16, wherein the outer fabric is selected from the group of materials consisting of polyester, wash-and-wear synthetic-natural fiber blends and corduroy.

18. The method of claim 17, wherein that the liner fabric is polyester.

19. A method of constructing seam joint means for a durable, lined garment that is capable of being repeatedly washed in a water-based solution containing laundering agents without suffering serious deleterious effects to the garment, comprising the steps of:

providing an outer fabric that is made from a washable material, a liner fabric made from a washable synthetic material, a wiggin and a flexible fabric tape;

firstly joining the wiggin to the outer fabric with a straight stitch;

layering together, in order of arrangement, the tape, the wiggin, the outer fabric and the liner fabric to form a layered structure having a common edge;

secondly joining the layered structure with an overlock stitch at or adjacent to the common edge;

thirdly joining the layered structure with a tacking stitch spaced apart from and parallel to the overlock stitch; and fourthly joining the outer fabric to the tape with adhesive means.

20. The method of claim 19, wherein the step of fourthly joining includes the steps of folding the outer fabric over the wiggin and the tape and joining the outer fabric to the tape with the adhesive means.

21. A method of claim 14 comprising the further step of:

washing the lined garment in a washing machine with said water-based solution containing laundering agents.

22. The method of claim 21, further comprising the step of drying the lined garment in an automatic dryer after the washing step.

23. The method of claim 21, further comprising the step of effecting a plurality of said cleanings without deleterious effect on the garment.

24. The method of claim 22, further comprising the step of effecting a plurality of said cleanings without deleterious effect on the garment.

25. The method of claim 21, characterized in that the laundering agents comprise at least one member of the group consisting of detergents, softeners, whiteners, and enzyme cleaners.

26. A method of claim 14 comprising the further step of:

providing said lined garment in the form of a blazer; and washing the lined blazer in a washing machine with said water-based solution containing laundering agents.

27. A durable, lined garment capable of being repeatedly washed in an aqueous laundering solution without serious deleterious effects on the garment, comprising a hem joining a washable fabric made from washable materials, a heat fusible finish fabric and a flexible, non-woven fabric tape, the hem characterized in that:

the finish fabric is fused to the washable fabric;

one side of tape is layered against an exposed side of the finish fabric;

an overlock stitch joins the tape, the finish fabric and the washable fabric at a common edge of each;

a straight stitch spaced from the overlock stitch further joins the tape, the finish fabric and the washable fabric;

an other side of the tape is folded back over onto the finish fabric; and the first and second sides of the tape are further joined to the finish fabric by adhesive means.

28. A method of claim 19, comprising the further step of:

washing the lined garment in a washing machine with said water-based solution containing laundering agents.

29. A method of claim 19, comprising the further step of:

providing said lined garment in the form of a blazer, and washing the lined blazer in a washing machine with said water-based solution containing laundering agents.

* * * * *